US005645442A

United States Patent [19]

Cairns

[11] Patent Number: 5,645,442

[45] Date of Patent: Jul. 8, 1997

[54] SEALED, FLUID-FILLED ELECTRICAL CONNECTOR

[75] Inventor: James L. Cairns, Ormond Beach, Fla.

[73] Assignee: Ocean Design, Inc., Ormond Beach, Fla.

[21] Appl. No.: 374,803

[22] Filed: Jan. 19, 1995

[51] Int. Cl.[6] ..... H01R 4/60

[52] U.S. Cl. ..... 439/201; 439/271

[58] Field of Search ..... 439/190, 191, 439/201, 204, 206, 207, 208, 278, 279, 936

[56] References Cited

U.S. PATENT DOCUMENTS

| | | | |
|---|---|---|---|
| 3,522,576 | 8/1970 | Cairns . | |
| 3,643,207 | 2/1972 | Cairns . | |
| 3,729,699 | 4/1973 | Briggs et al. . | |
| 3,845,450 | 10/1974 | Cole et al. . | |
| 4,039,242 | 8/1977 | Wilson et al. | 439/199 |
| 4,085,993 | 4/1978 | Cairns . | |
| 4,142,770 | 3/1979 | Butler, Jr. et al. . | |
| 4,174,875 | 11/1979 | Wilson et al. . | |
| 4,186,986 | 2/1980 | Shoemaker | 439/204 |
| 4,373,767 | 2/1983 | Cairns | 439/199 |
| 4,479,690 | 10/1984 | Inouye et al. . | |
| 4,589,717 | 5/1986 | Pottier et al. . | |
| 4,606,603 | 8/1986 | Cairns | 350/96 |
| 4,795,359 | 1/1989 | Alcock et al. | 439/271 |
| 4,948,377 | 8/1990 | Cairns | 439/200 |
| 5,171,158 | 12/1992 | Cairns | 439/199 |
| 5,194,012 | 3/1993 | Cairns | 439/201 |

*Primary Examiner*—Hien Vu

*Attorney, Agent, or Firm*—Brown, Martin, Haller & McClain

[57] ABSTRACT

A submersible connector for use in an underwater environment. The submersible connector has a receptacle and a plug, which are mated together. The receptacle has a shell, an inside chamber, a circuit contact, an outside chamber, and a stopper. The chambers both contain dielectric fluid. When demated, the stopper is disposed in the inside and outside chambers, and those chambers are open to one another, permitting free flow of dielectric fluid therebetween. The plug has a conductive plug probe. As the plug probe is inserted into the receptacle, it first enters the outside chamber. The outside chamber has an end-seal and is closed-off from the outside environment by the stopper in contact with the end-seal, when demated, and by the plug probe in contact with the end-seal, when mated. The plug probe is inserted farther into the outside chamber, it forces dielectric fluid into the inside chamber, which has a flexible bladder that expands with increases in volume in the inside chamber. The probe then enters the inside chamber and makes contact with the circuit contact and thereby makes an electrical connection. When fully inserted into the receptacle, the probe lightly seals-off the outside from the inside chamber, forming a non-fluid-tight seal between the two chambers.

17 Claims, 5 Drawing Sheets

SEALED, FLUID-FILLED ELECTRICAL CONNECTOR

BACKGROUND OF THE INVENTION

1. Field of the Invention

The present invention relates to the field of electrical pin-and-socket type connectors that are intended for use in volatile, conductive or corrosive environments. Connectors of this sort generally have receptacles with socket contacts that are sealed from the exterior environment before, during and after mating and demating. There is one category of these that accomplish the sealing by having the connector receptacle filled with dielectric fluid that is retained by penetrable seals within the receptacle. The fluid is free to move about within the receptacle, and thus is displaced as the plug pins enter during mating. One or more flexible elements are generally provided to accommodate the increase in volume within the receptacle due to the insertion of the plug pins.

2. Description of the Related Art

Typical examples of related art are given in U.S. Pat. Nos. 5,203,805, and 4,948,377 which are suggested as reference material. For clarity in the following discussion the term "module" refers to the assembly that makes-up each individual circuit within the connector, whereas the term "common" refers to features which are shared by all circuits. For instance, the outer shell of such a connector would be a "common" feature, whereas an individual electrical socket would be a feature of one of the circuit "modules" within the connector. In these examples each socket of the receptacle portion of the connectors is constructed as a separate module housed within a respective separate, sealed, flexible-walled chamber. Within the chamber is a spring and an elongated-shaft stopper. The stopper is urged outward (toward the receptacle mating face) by the spring, but is captured in such a way as to limit its outward travel to a point where the tip of its elongated shaft just reaches the mating face of the receptacle. The chamber has an elastic end-seal which constrictively fits to the shaft of the stopper and thus seals to it. All other interfaces of the chamber are affixed with seals so that the chamber may be filled with dielectric fluid and does not leak.

The corresponding connector plug which mates to the above described connector receptacle has respective plug pins that mate to their respective receptacle sockets. Each such plug pin has an elongated shaft sheathed in a dielectric covering, and has an exposed conductive tip. The pin has substantially the same diameter as the stopper of its respective receptacle socket, although the pin is often just slightly larger in diameter for reasons not important here, but discussed later.

When the above described plug and receptacle are mated, the tip of each respective plug pin engages the tip of each respective stopper and forces it inward into its socket, meanwhile compressing the spring. The fluid which is displaced by the entrance of the pin into the fluid-filled receptacle is accommodated by a compliant element of the module chamber which flexes, increasing the chamber's volume.

Demating the connector results in the reverse sequence of events. As each pin is withdrawn from its socket, the spring causes the socket's stopper to faithfully follow the pin outward into the end seal of the module chamber. The end seal is therefore always occupied, either by the plug pin or by the stopper, and does not leak dielectric fluid out or allow the material of the outside environment (eg. seawater) to seep in.

It will be appreciated in contemplating the foregoing sequence of actions that the socket's electrical contacts, being well within the module's fluid chamber, never are exposed to, or have contact with the outside environment. Therefore, the socket contacts can remain electrically energized before during and after mating and demating the connector. And any arcing which may occur during these actions is contained within the dielectric fluid, so that such connectors are spark-proof to the outside environment.

As may be seen in the referenced examples, to gain an additional measure of isolation of the socket electrical contacts, the above described socket modules are separated from the outside environment by an additional fluid volume and one or more additional end-seals through which the stopper sealably passes in the unmated condition, and through which the plug pin sealably passes in the mated condition. Thus when mated, each respective plug pin engages the tip of each respective stopper and urges it inward through a first end-seal, through an intermediate fluid bath, and then through an additional constrictive seal, and into the socket module's fluid-filled chamber. When fully mated, therefore, the conductive tip of the plug and the electrical contact of the socket are fully contained in dielectric fluid within the socket-module chamber and are separated from the exterior environment by two seals which themselves are separated by an additional dielectric fluid bath or chamber.

The additional fluid chamber and seal offer several advantages: The additional chamber (bath) provides a depository for contaminants that might slip past the first seal, and the second seal acts as an additional wiper as well as prohibiting the free migration of contaminants from the added bath into the inner module chamber containing the electrical contacts.

The above references demonstrate two methods used to provide the additional bath and seal. The U.S. Pat. No. 4,948,377 patent shows all of the previously described socket modules housed within a larger "common" chamber. The common chamber has a multiplicity of ports through its elastomeric end wall that constrictively seal to the elongated shafts of the stoppers in the unmated condition, and to the plug pins in the mated condition. As mating of the '377 connector proceeds, the respective plug pins engage the tips of their respective stoppers and urge them inward. Each plug pin passes through a first seal, which is an elastomeric port in the end-wall of the common chamber, thence through the common oil chamber, in which any contaminants that slip past the first seal are expected to be deposited, and thence through a second seal and into the individual module oil-chamber of its respective socket module. The arrangement offers an improvement over earlier related art such as described in U.S. Pat. Nos. 4,142,770 and 3,729,699 which had only single seals and baths. But it still has a disadvantage that any contamination which might enter into the common bath (chamber) from any one of the end ports, as might occur if the elastomeric port were damaged, would contaminate the whole common bath surrounding all of the socket modules. A flaw in any one of the common-chamber elastomeric ports could therefore negate the beneficial effect of the outer bath for all of the module chambers. As a point to be returned to later, it will be noted that in the '377 embodiment the socket modules are completely contained within the outer common chamber; therefore, as the modules swell and retract due to the insertion and withdrawal of the plug pins so must the common chamber flex to accommodate the changing volume.

The possibility of contamination of the common chamber via a single failed end-seal, as well as other improvements, are addressed in the art of U.S. Pat. No. 5,203,805. In that patent, an embodiment is described that creates a separate, second, outer (in the sense of being toward the mating-face of the receptacle) chamber and end-seal for each socket module, said elements being axially aligned with the inner socket-module chamber, stopper and end-seal. And although there is still a common all-surrounding chamber, it is a sealed chamber with no communication to any other volume. It therefore is not subject to contamination. The axially aligned second bath and end seal are a part of each module, and do not communicate with the common chamber or with the chambers of any of the other modules in the connector. In that embodiment, there is free communication between the module's inner fluid-filled chamber and second, outer chamber (bath) of each socket module in the unmated condition. The communication is allowed via flow past a narrowed segment of the stopper.

The communication of fluid between the two axially-aligned module chambers of the '805 socket module is cut-off in the mated condition by the engagement of the interior seal with the plug-pin shaft. But in the unmated condition limited communication is permitted by flow past the small-diameter segment of the stopper. That allows replenishment of any fluid lost from the module's outer chamber with fluid from the module's internal chamber when the connector is unmated, but still serves to substantially retain contaminants within the outer chamber. The design of the '805 patent is very successful, but still has some drawbacks. One drawback is that the narrowed stopper is not as robust as would be desired. A second is that the end structure of the socket module which is comprised of the outermost seal, the outer chamber wall, and the narrowed stopper is not well supported, and is flimsy. In use, the whole end of the module assembly could be pushed inward, out of position in the overall connector assembly, and damage to the narrowed stopper can occur. The thin outer-chamber wall is likewise subject to easy damage. These drawbacks, coupled with a desire to provide multiple more than two wipers within the end-seal complex has prompted the improvements which are the subjects of the present patent application.

These improvements are made possible in part by the realization that the outer chamber of the '805 socket module need not be volume (or pressure) compensated. The '805 outer module chamber has a thin, flexible outer wall intended to flex in and out to accommodate volume changes within it due to the sliding passage of the pin and stopper through it during mating and demating. But this outer module chamber communicates to the inner chamber at all times except when the plug pin is inserted through it. During the mating sequence the plug pin passes through the end seal and into the outer module chamber. Fluid in the outer module chamber that is displaced by the plug is free to flow into the inner module chamber up until the point where the entering plug pin seals-off the passage between the outer and inner chambers. But at that point, even though the shaft of the pin continues to slide through the outer module chamber, no net additional material enters the outer module chamber. As a new portion of the plug-pin shaft slides in one end, an old portion slides out the other end. Once sealed-off by the entering pin, at which point it actually becomes a separate chamber, the volume of the outer module chamber is constant. The same argument is applicable when the pin is withdrawn during demating. So no volume compensation of this outer module chamber is necessary to accommodate the insertion/withdrawal of the plug-pin during mating/demating. One might argue that some small-scale volume compensation in the outer module chamber might still be necessary to account for material bulk-property changes that might occur to the oil and the elastomeric outer-chamber body as a result of thermal or pressure effects. But these are easily overcome by choosing elastomers and dielectric fluids that have identical thermal expansion and pressure contraction coefficients. In fact the silicone oil and rubber compounds used in these connectors do have identical thermal and pressure coefficients. It is well known that in reaction to applied pressure, elastomers behave as fluids for small displacements, so the dielectric fluid and the outer chamber walls react in harmony to pressure and thermal effects. It is as if they were a single substance. So in fact, no volume compensation is required of the outer module chamber.

Another point alluded to earlier is the additional realization that the '805 outer socket-module chamber, being axially aligned with the inner socket-module chamber, need not react to volume changes of said inner chamber. In the '377 connector, the inner socket module is completely enclosed by the outer common chamber, which common chamber also served as the outer chamber to the socket-module. Thus, in the '377 connector the outer chamber had to expand to accommodate the insertion of the plug pin because the insertion caused the module chamber to expand, and the module chamber was completely within the outer chamber. In the '805 connector the common chamber does likewise have to expand, but that has nothing to do with the outer module chamber.

As will be seen, the present invention takes advantage of these realizations to provide an improved connector having a ruggedized construction and efficient, multiple module end-seals.

SUMMARY OF THE INVENTION

Accordingly, the present invention is directed toward an electrical connector of the aforementioned type having a fluid-filled receptacle comprised of robust socket modules each with (a) an inner chamber, and (b) an end-seal, with a plurality of wiping elements within said end-seal, said wiping elements defining a plurality of fluid-filled annular spaces, or sub-chambers, within which contaminants can be deposited and which have limited communication with each other and with the main internal chamber.

Additional features and advantages of the invented connector will be set forth in the description that follows, and in part will be apparent from the description, or may be learned by practice of the invention. The objectives and other advantages of the invention will be realized and attained by the apparatus and method particularly pointed out in the written description and claims hereof, as well as the appended drawings.

To achieve these and other advantages, and in accordance with the purpose of the present invention, as embodied and broadly described herein, the present connector is a sealed, spark-proof electrical connector to be used in volatile or other harsh environments such as corrosive or conductive fluid environments like seawater.

It is to be understood that both the foregoing general description and the following detailed description are exemplary and explanatory only and are not restrictive of the invention, as claimed.

The accompanying drawings are included to provide a further understanding of the invention and are incorporated in and constitute a part of this specification. In addition, the accompanying drawings illustrate the embodiments of the invention and, together with the description, serve to explain the principles of the invention.

DESCRIPTION OF THE PREFERRED EMBODIMENT

Figure 1:
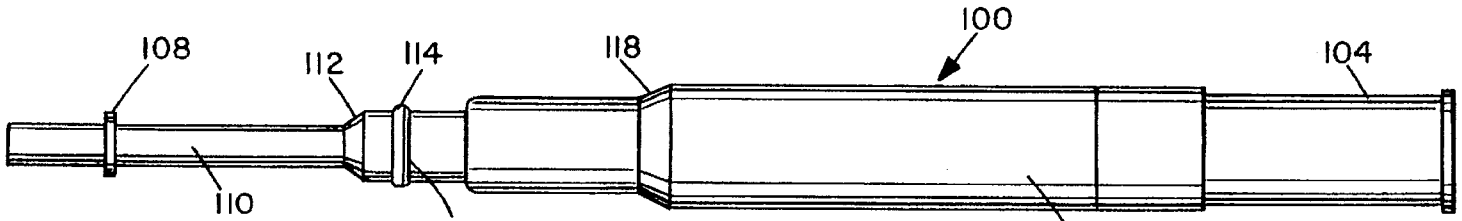
FIG. 1 is a side elevation view of an electrical socket assembly.

Reference will now be made in detail to the present preferred embodiment of the invention, an example of which is illustrated in the accompanying drawings. Wherever possible, the same reference numerals will be used throughout the drawings to refer to the same or like parts.

In accordance with the present invention, a fluid-filled submersible connector is provided which has a receptacle and a plug, these parts being mated to make the electrical connection. The plug is identical to that of U.S. Pat. No. 5,203,805, by the present inventor, which has been previously introduced, and which is incorporated herein by reference. The receptacle is changed from that of '805 only in the area of the outer module-chamber and end-seal. The receptacle has one or more circuit modules, each with an inside module-chamber having a flexible wall, bladder, or other compliant member, and a module-chamber end-seal, which has a passageway forming a sealable opening into which are incorporated one or more corrugations. These corrugations comprise one or more nibs that act as wipers and flow-restrictors, and which form annular fluid chambers to trap contaminants collected by the wiping nibs.

Figure 5:
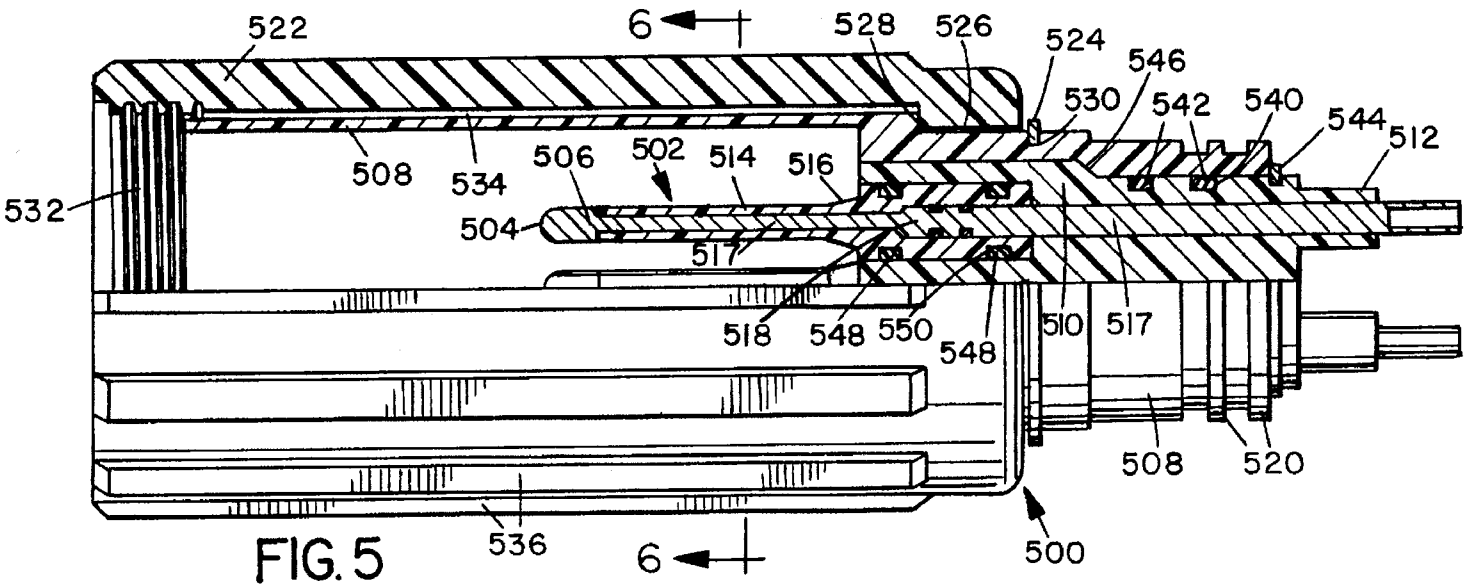
FIG. 5 is a side elevation view, in partial section, of a connector plug including a plurality of conductive probe assemblies in accordance with the present invention.
Figure 6:
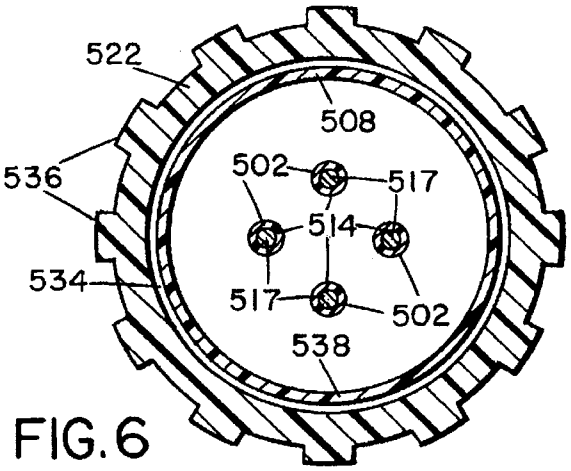
FIG. 6 is a sectional view taken along line 6—6 of FIG. 5.
Figure 3:
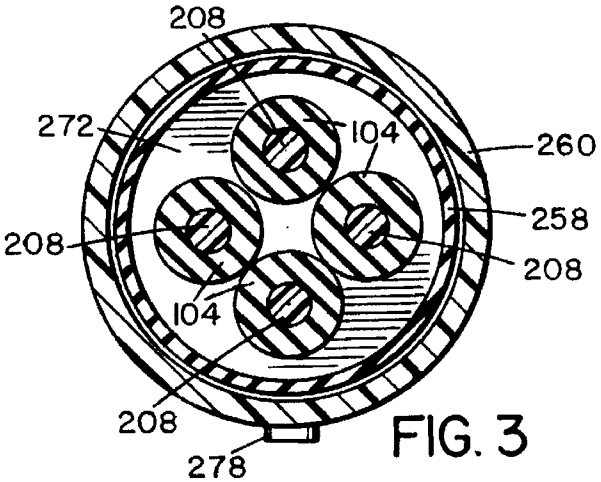
FIG. 3 is a sectional view taken along line 3—3 of FIG. 2.

An example of a preferred embodiment of the receptacle element of the present invention including the electrical socket-module assemblies, is shown in FIGS. 1–4. The receptacle element is designated generally by reference numeral 200 and the electrical socket-module assemblies by reference numeral 100. A preferred embodiment of the plug element is shown in FIGS. 5 and 6 and is designated generally by reference numeral 500.

Figure 2:
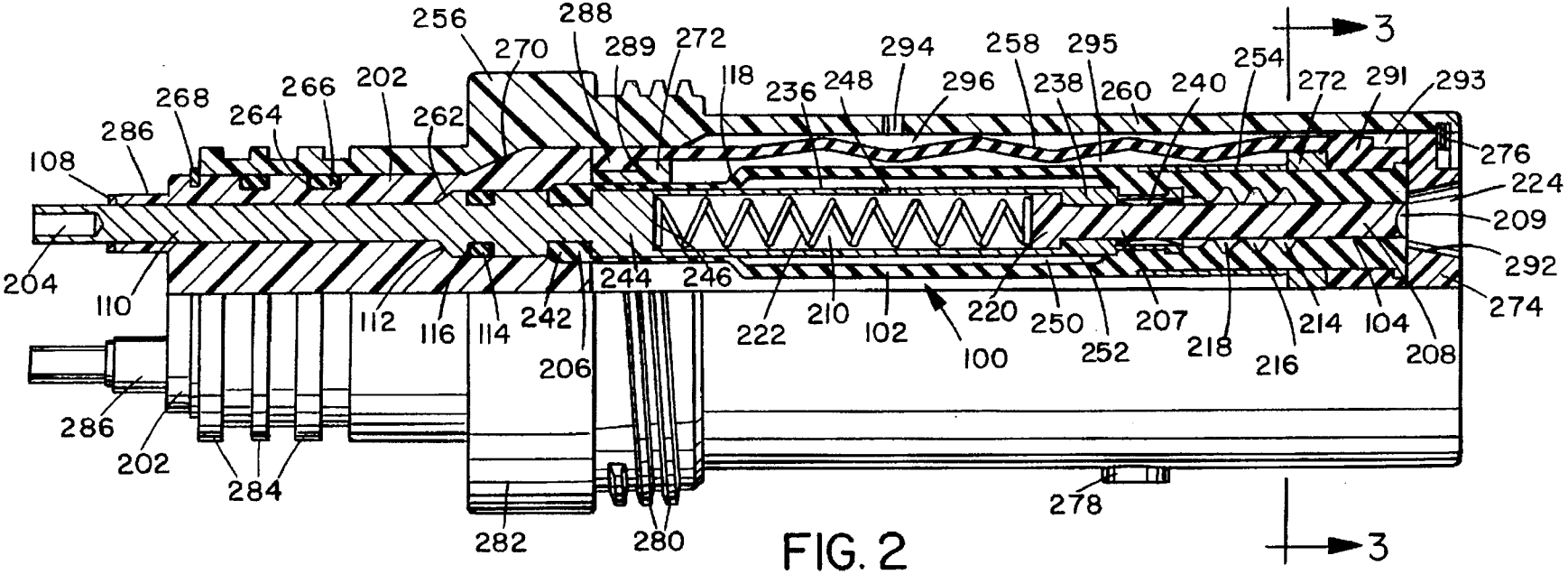
FIG. 2 is a side elevation view, in partial section, of a connector receptacle including a plurality of electrical socket assemblies in accordance with the present invention.

Referring now to FIGS. 1 and 2, the electrical socket module 100 includes bladder 102 made of a flexible, elastic, nonconductive material, such as a natural or synthetic rubber. The flexible bladder 102 essentially forms a complex, multi-region chamber, within which an electrical socket structure is disposed. The bladder forms a sealing member incorporating an end-seal 104 formed the flexible bladder 102 for sealing one end of the bladder 102. Another seal 206 is formed on the other end of the flexible bladder 102. The flexible bladder 102 is essentially cylindrical in shape, with both of the seals 104, 206 consisting of annular structures, each pierced through with a passageway opening into the flexible bladder 102. The material from which the flexible bladder 102 is formed is elastic, so that the seals 104, 206 radially constrict against objects inserted into their respective passageways to form respective barriers resistant to fluid and pressure. A dielectric fluid fills the bladder 102. The dielectric fluid may have the same characteristics as the fluid that fills the bladders of the Inventor's U.S. Pat. Nos. 3,643,207, 4,085,993, 4,606,603, 4,948,377, and 5,203,805, and the dielectric fluid is used for the same purposes. The dielectric fluid may also have certain other characteristics, as described in detail below. Annular seal 104 forms a sealable opening from the chamber within bladder 102 to the outside, underwater environment.

A movable dielectric stopper 207 has a forward extension (shaft) 208, which extends through the passageway formed in the end-seal 104. The stopper 207 is free to move axially within the complex chamber formed by the bladder 102. The radially constrictive force exerted by the end-seal 104 through the passageway seals the end-seal 104 against the smooth elongated shaft 208 to form a fluid and pressure resistant barrier. The barrier prevents the transfer of fluid between the interior and exterior of the bladder 102 and vice versa.

The complex chamber formed by the interior of bladder 102, in the unmated condition, has multiple interconnecting zones 210, 212, 214, 216, 218, 234. The stopper 207 in its unmated position extends through each of the zones 210, 212, 214, 216, 218, 234. During the mating sequence, the stopper 207 moves to its retracted position, as will be described in more detail below.

Figure 4:
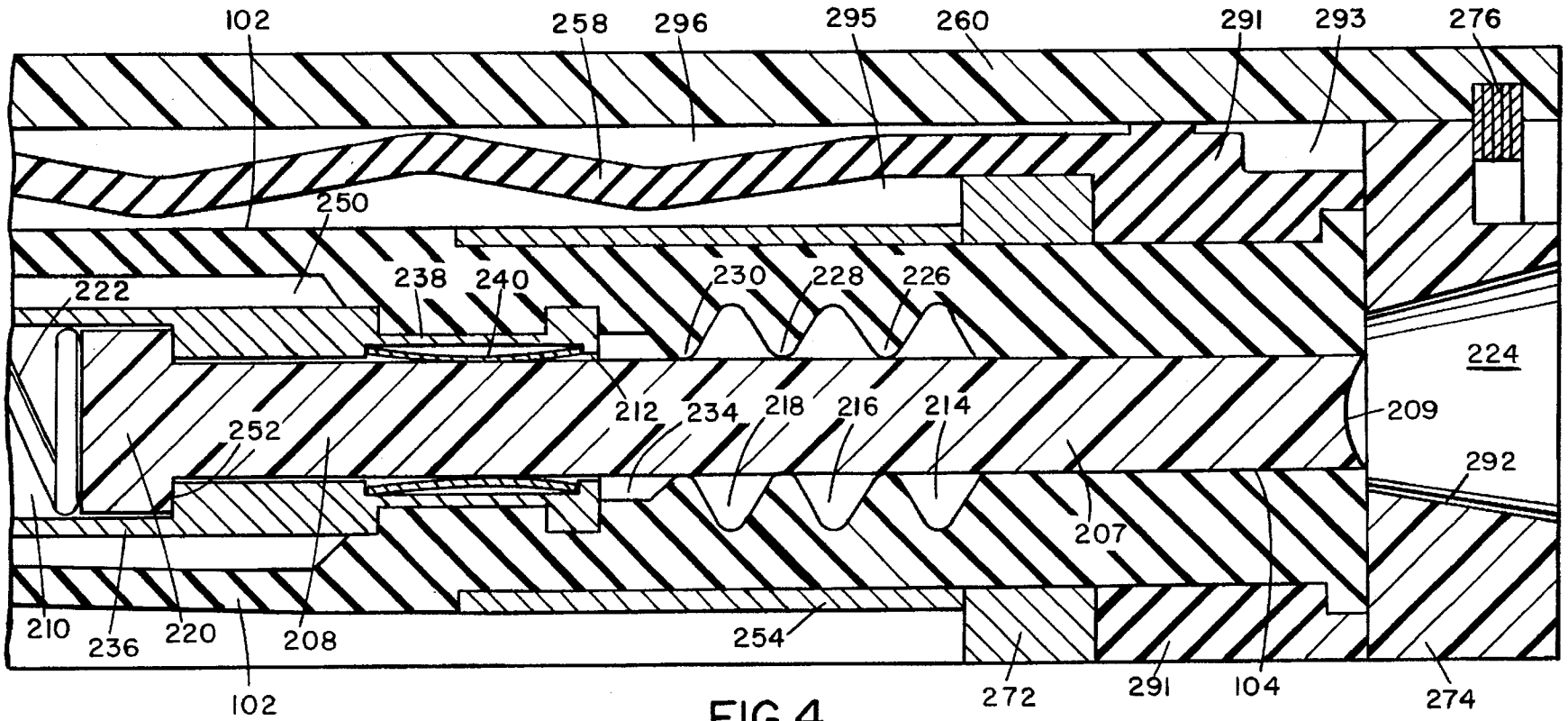
FIG. 4 is an enlarged view of the electrical socket assembly shown in the partial section of FIG. 2.

FIG. 4 shows an enlarged view of the stopper 207 in the unmated position, illustrating in greater detail the various zones of the chamber and the relation between the stopper 207 and those zones. The stopper 207 has an enlarged-diameter flange 220 that abuts a spring 222. The spring 222 resiliently biases the stopper 207 into its outermost position, thereby forcing the elongated shaft 208 into the end seal 104. As can be seen in FIG. 4, the flange 220 has a larger diameter than shaft 208, which extends from the flange 220 in substantially the same diameter to the ultimate concave tip 209 of the stopper 207. In the unmated condition, the elongated shaft 208 is sealed constrictively by the inner bore of end-seal 104 preventing the passage of fluid past the seal. The elongated shaft 208 of the stopper 207 has a larger diameter than the bore of seal 104. Accordingly, when the elongated shaft 208 is inserted into end seal 104, end seal 104 constrictively squeezes around shaft 208, sealing to it. The sealing member forming annular end seal 104 also incorporates a plurality of annular nibs in series. The nibs 226, 228, 230, together with the termination point 232 of the end seal 104, define annular regions or spaces 214, 216, 218, which each contain dielectric fluid. As those skilled in the art will appreciate, any number of corrugation nibs can be provided. As shown, there are three corrugation nibs.

When in the unmated position, the corrugations 214, 216, 218 are open to the other zones 210, 212, 234 of the module chamber, and all form a common albeit complex continuous fluid bath. Thus, in the unmated position, only one oil chamber exists, although its shape is very complicated, and communication between some of its parts is partially restricted. Because the end seal 104 has a smaller diameter than the shaft 208 of the stopper 207, when shaft 208 moves in and out of end seal 104, shaft 208 is wiped.

The various corrugations 214, 216, 218, function as depositories for any contaminants, such as sea water or silt, that may penetrate past the end seal 104 while clinging to the stopper shaft 208 or its tip 209, or to the pin of the plug, in their movement from the unmated to the mated position (i.e., from the extended to the retracted position), and thus in their movement through the respective corrugations.

As will be described in further detail below, as a conductive probe on the plug 500 is inserted into the bladder 102, through the end seal 104, the probe will engage the end 209 of the stopper 207, pushing the stopper 207 into a retracted position within the bladder 102. The probe follows the stopper tip 209 on its trip into the interior of the bladder 102, thereby replacing the stopper shaft 208 within the end seal 104. Thus, the probe forms a seal with the annular seals or nibs of end seal 104. When the probe is withdrawn, the stopper shaft 208 follows the probe as it leaves the passageway in end seal 104 and replaces the probe in the barrier formed with the end seal 104. One will appreciate that the mating and demating of a probe with the electrical socket assembly 100 does not require much expansion of the passageway in the end seal 104 when the probe is inserted, nor contraction of the passageway when the probe is removed. Because the stopper 207 eliminates the requirement for closing the end seal 104 when the probe is withdrawn, the need for the tightly constricting elements in some prior-art bladder assemblies is eliminated, thereby reducing the insertion and extraction forces necessary for mating and demating the electrical socket assembly 100 with a probe.

Stopper shaft 208 is slightly smaller in diameter than plug probe 502. By sizing the inner diameter of the nibs, so that they are just a bit larger than the diameter of the stopper shaft 208 and more-or-less the same size as the diameter of the plug probe 502, it is possible to have restricted communication between the annular fluid corrugations 214, 216 and 218 in the unmated condition. In the mated condition, the plug probe contacts the corrugation nibs 226, 228, 230 to form a light or non-fluid-tight seal between the annular spaces or sub-chambers thereby formed between the nibs. At the same time, this allows the shaft 208 of the stopper 207 to have a constant diameter. The fact that the stopper 207 does not contact corrugation nibs 226, 228, 230, in the normal sealing position of the stopper 207, further reduces the spring force required to actuate the stopper and hence the force required to insert the plug probe into and through the end seal 104. The weak, narrowed shaft-diameter region of the stopper in the '805 patent has been eliminated, accomplishing one of the objectives of the invention.

Returning to FIGS. 1 and 2, electrical conductivity is provided within the socket assembly 100 by a conductive rear piece 110, a cylindrical conductive tube 236, a conductive forward piece 238, and an annular circuit contact band 240. Each of the conductive elements 110, 236, 238, 240 is made of an electrically conductive material. The rear piece 110 has an annular groove 242 for receiving and sealing to the inner end seal 206 of the bladder 102, and a forward extension 244 that adjoins the cylindrical conductive tube 236. The cylindrical conductive tube 236 extends between the conductive rear piece 110 and the conductive forward piece 238, which is fixed into the forward end of the tube 236. As indicated in FIG. 2, the conductive rear piece 110, the cylindrical conductive tube 236, and the conductive forward piece 238 when thus assembled effectively form a single unit of conductive material. The annular circuit contact ring 240 is seated in the forward conductive piece 238. Electrical conductivity is thus provided from the forward end of the bladder 102, out through the rear end of the bladder.

The stopper return spring 222 is disposed inside the cylindrical conductive tube (or spring guide) 236. The spring 222 acts between face 246 of the conductor 244 and the flange 220 of stopper 207.

When a probe is inserted into the electrical socket assembly 100 and moves the stopper 207 rearwardly within the bladder 102, dielectric fluid in the inside chamber 210 is displaced somewhat by the rearward motion of the stopper 207. This results in an expansive deformation of the bladder 102. As shown in FIG. 2, the dielectric fluid in the inside chamber 210 is ported through a radial hole 248 in the cylindrical conductive tube (or spring guide) 236. In this way, dielectric fluid can move between the inside chamber 210 of the conductive spring guide tube 236 and the module chamber 250 defined by the flexible bladder 102.

Flange 220 is a loose fit in tube 236 as is shaft 208 in bore 238 of the conductive assembly. Accordingly, fluid passes fully around the stopper everywhere along its length except for the outward position of shaft 208 when it is properly engaged in end seal 104.

Referring now to FIGS. 2, 3, 7 and 8, the plug probe 502 has a probe tip 504 that is convex in shape and that engages the concave face 209 in the end of the stopper shaft 208. When the stopper 107 is pushed inward by probe 502, probe 502 enters the forward passageway through the end seal 104 and when fully inserted, engages the conductive circuit contact ring 240 to establish conductivity between the probe 502 and the conduction apparatus in the socket assembly 100. During the insertion through the end seal 104, the probe 502 pushes the stopper 207 inwardly into the conductive spring guide tube 236, thereby compressing the spring 222. The spring 222 may be of such a dimension that the stopper 207 can be pressed into the tube 236 and will be recessed only to the point where the concave face 209 is displaced just to the rear of the annular circuit contact ring 240 within the conductive bore 238 of the conductive spring guide tube 236. The bore 238 acts as a longitudinal guide for the stopper tip 209, aligning it longitudinally with the passageway in the end seal 104, the spring 222 urges the stopper 207 to follow the probe faithfully forward into the breach; the stopper 207 follows the probe 502, until the probe 502 is completely withdrawn, at which point it has urged stopper 207 forward until the large cylindrical drum 220 engages a shoulder 252 on the conductive spring guide tube 236. The diameter of the cylindrical drum 220 is slightly less than the interior diameter of the conductive spring guide tube 236, so that the spring guide tube 236 acts as a guide to the cylindrical drum 220. Moreover, because the diameter of the drum 220 is less than the interior diameter of tube 236, dielectric fluid can flow past the drum 220 as the stopper 207 is being displaced within the inside chamber 210.

As shown in FIGS. 1 and 2, the end piece 110 includes an annular groove 116 that provides a seat for an O-ring seal 114. The end piece 110 has a tapered transition forming a load-bearing shoulder 112, and a solder pot 204 bored in its furthest tip. A snap ring 108 is seated in an annular groove in the outer surface of the end piece 110.

In summary, then, the structure of the electrical socket-module assembly illustrated in FIGS. 1–8 provides a protected environment for a contact surface (the ring or band 240), which is entered through the end seal 104. The stopper 207 ensures that the end seal 104 never has to close completely to a zero-diameter hole when the probe 502 is withdrawn from the end seal 104. The end seal 104 acts constrictively against the stopper shaft 208 and against the male probe 502, which has a slightly larger diameter than the stopper shaft. Thus, the end seal 104 is always filled with some solid matter, either the elongated shaft 208 or the probe 502. There is never a requirement for the end seal 104 to substantially alter its dimensions. Therefore, only a minimal amount of stretch of the end seal is required for cycling the probe 502. The bladder material is selected to be substantially elastic, so that the end seal 104 is not leaky, and it will be appreciated that since the pressure internally to chamber 210 is substantially matched to that of the outside environment by way of vents 294 and 248 and flexible walls 258 and 102, no need exists for the seal 104 to seal against high pressure gradients.

The functioning of the seal at the forward end of the electrical socket assembly 100 may be enhanced as shown in FIGS. 2 and 4, by the addition of a rigid tube 254, which along with an axially aligned bore through rigid spacer 272, conformally restrains the outside of the heavy-walled corrugated portion of the module bladder from radial expansion. As explained in the introductory remarks, the annular fluid regions 214, 216 and 218 of the corrugations have no need for volume or pressure compensation, and therefore what was a thin-membrane, flexible (and hence delicate) outer module-chamber wall in the connector of patent '805 has become a heavy-walled region within a rigid conformal bore in the present invention. The heavier wall, along with the rigid back-up provided by tube 254 and the axially aligned bore through spacer 272, give the wiper nibs something to react against, thereby improving their wiping efficiency. And the whole structure is not only more robust, but firmly constrained from squirming inward. Thus two more of the objectives of the present invention, ruggedness and position-retention of the module outer-chamber structure, have been achieved.

In movement of the probe 502 through end seal 104, the probe 502 contacts the stopper 207 and forces it inwardly. Probe 502 is wiped clean by end seal 104 as it moves sealably through it and thence, through the corrugations formed by nibs 226, 228, 230, which are intended to wipe-off and capture any remaining contaminants. Impurities from the conductive tip 506 and shaft of the probe 502 are thus deposited in the annular oil baths 214, 216 and 218 of the corrugations. As FIG. 8 shows, nibs 226, 228 and 230 lightly seat against probe 502 restricting fluid flow between the annular fluid segments 214, 216 and 218 trapped between them, such fluid segments having been in much more free communication with each other and with zone 210 prior to the insertion of the probe. The corrugation nibs 226, 228, 230, as well as the end seal 104, each act to wipe the probe 502 as it passes by. The stopper 207 is simultaneously forced to the completely retracted position shown in FIG. 7. The inward movement of the probe 502 contacts the tip 209 of the stopper 207 and pushes it backward. The probe 502 is then wiped by the constricted opening of the end seal 104 and by the corrugation nibs 226, 228, 230, and passes into the inside oil bath 212, where the conductive end 506 of the probe 502 makes electrical contact with the conductive circuit contact 240.

The dielectric fluid and the corrugation nibs function to prevent a conductive path forming between the forward conductive part 238 of the module 100 and the external environment. Such a conductive path can conceivably be created by a small scratch through the end seal 104 caused by sand, or a burr on the probe 502. Under certain circumstances, the scratches may contain traces of electrically conductive sea water. The combination of the multiple wiping nibs and fluid annuli prevents conduction under such circumstances.

Referring again to FIG. 2, the receptacle 200 is shown for a sealed electrical connector that has a fluid-filled flexible bladder which forms a common chamber enclosing a plurality of electrical socket-module assemblies 100. The receptacle 200 illustrated in FIG. 2 includes a receptacle shell 256 constructed of metal or high impact plastic or other suitable material enclosing a fluid-filled bladder 258 that defines a common chamber. The receptacle shell 256 includes an elongated sleeve 260 that is substantially cylindrical and end cap 274 (where port 224 is located) with through-bores for accepting the ends of respective electrical socket assemblies 100.

The electrical socket assembly 100 is seated in the rear portion of the shell 260 in a base 202 that is formed from rigid plastic or other suitable non-conductor material. The base 202 has a plurality of through-bores formed in it, each of which has a load bearing seat 262, against which the load bearing shoulder 112 of the socket assembly 100 is engaged. The socket assembly 100 is retained within the through-bores of the base 202 and against the load bearing seat 262 by snap ring 108. The tip of the end portion 110 of the socket assembly 100 projects out from base 202, exposing the solder pot 204. The base 202 includes two annular grooves 264, in which are seated o-rings 266. A snap ring 268 and a load bearing shoulder 270 retain base 202 within the shell 260. The O-ring 266 prevent the entry of water along the dividing surface between the shell 260 and the base 202.

A common bladder assembly 258 is formed from a flexible, elastic material, such as a natural or synthetic rubber. It may be maintained in an elongated, cylindrical configuration by a common bladder spacer, or support 272. The common bladder spacer 272 is illustrated and described in detail in the inventor's U.S. Pat. No. 5,203,805, incorporated above by reference. An end cap 274 retains the common bladder assembly, including the common bladder spacer 272 and the flexible common bladder 258, in the receptacle-sleeve bore. The end cap 274 is retained in the receptacle shell 260 by a snap ring 276.

The structure of the receptacle shell 260 includes a mating key 278 on the outer surface of the sleeve 260, mating threads 280, and an enlarged-diameter shoulder 282 aft of the threads 280. Grip rings 284 are formed behind the shoulder 282. Base 202 has nipples 286 that extend outward from the base 202. These nipples act in concert with elastomeric sleeves (not shown) to form an insulative barrier sleeve between the wire junction (not shown) and the base 202 when the connector is terminated to an electrical cable.

The structure of the common bladder assembly 258, 272 includes a rear seal 288 formed against a rear seal seat 289 in the rear portion of the common bladder spacer 272. A front seal 291 is formed in the forward end of the flexible common bladder 258. The front seal 291 includes multiple through passageways, or holes, that constrictingly fit around the other surface of the end seal 104. Rigid tube 254 and bores 272 acting with the flared end of 104 keep the end-seal portion 104 of the assembly 100 in place within the respective hole in the end of 291 through which it sealably extends. The holes are maintained in rotational alignment with respective corresponding passageways, or holes, on the forward end of the spacer assembly 272 by means of an end seal alignment key on the bladder spacer 272. The alignment key is illustrated and described in the Inventor's U.S. Pat. No. 5,203,805, incorporated herein by reference, and is received in a corresponding keyway of the front seal 292. The tapered surface 292 provides for guidance of the probe 502 into the passageway in the electrical socket assembly 100 holding the stopper 207. The end cap 274 is mounted in the receptacle shell 260 to retain front seal 291 in position.

An annular void 293 is formed between front seal 291, the rear end of the end cap 274, and the interior surface of the receptacle sleeve 260. The void 293 provides a space into which the front seal 291 can slightly deform, if necessitated by the passage of a probe 502 into the end seal 104. The inside flexible bladder 102 (and each of the other socket assemblies in the receptacle 200) are individually filled with dielectric fluid through their end opening by depressing the stopper 207. The void 293 is vented to the outside environment through grooves in the end cap 274. The common chamber formed by bladder 258 may be filled with dielectric fluid through a hole that is normally sealed by a plug on the end cap 274.

The exterior surface of the common bladder 258 is vented to the outside environment through at least one vent hole 294 in the receptacle shell 260. The venting provides for equalization of the pressure between the outside (eg. underwater) environment and the interiors 250, 295 of the fluid-filled inside of bladders 102, 258, respectively.

The o-ring 114 seals the through-bore in the base 202 to prevent fluid flow between the outside environment and the interior of the common flexible bladder 258. It is to be understood that the function of the common oil bath 295 defined by the common flexible bladder assembly 258 serves as a secondary environmental seal in the case of failure of a module bladder 102.

Now, one will appreciate that as a probe 502 is inserted into the port illustrated by the cutaway portion of FIG. 2, the probe 502 contacts the tapered surface 292 and is guided through the opening 224 into the end seal 104, where it contacts the concave face 209 of the stopper shaft 208. When the convex face 504 of the probe 502 engages the concave face 209, it pushes the stopper 207 inwardly into the socket assembly 100. Thus, as the probe 502 is inserted through the end seal 104 into the socket assembly 100, it displaces the shaft 208 against the force exerted by the spring 222. Also, when the probe 502 is withdrawn from the receptacle port, the stopper shaft 208 follows the probe 502 back through the port. Thus the end seal 104, being formed of an elastic material that is stretched into tension, exerts a constricting force on the passageway formed by the end seal 104. This constricting force closes the hole into a sealing engagement with the elongated shaft 208, or with the probe 502. Probe 502 has a slightly larger diameter than the shaft 208 of the stopper 207 because probe 502 is intended to engage circuit contact band 240 and nibs 226, 228 and 230, whereas shaft 208 is not. By passing freely through band 240 and the nibs, the force required to move the stopper is minimized. Additional stretching of the end seal 104 also acts to wipe clean the exterior surface of the probe 502 when the probe 502 is inserted into and extracted from the receptacle.

The plug portion 500 of the connector of the present invention will now be described with reference to FIGS. 5 and 6. As embodied herein, the plug assembly 500 includes a plug body 508 housing a rigid dielectric base 510 in which are disposed conductive probe assemblies, one of which is illustrated in detail and indicated by reference numeral 502. The probe assembly 502 has a conductive tip 506, which has a convex face 504, and the probe 502 is formed of a conductive material, preferably a metal. The end portion of the probe 502 may be sealed to attach wires by a boot seal 510, for which nipples 512 are provided. Construction of the plug body 508 includes formation of a dielectric outer probe shell 514, which tapers at its base 516, and an interior conductive shaft 517. The combination of the probe other shell 514 with the tapered base 516, the conductive tip 506, and the conductive shaft 517, forms one of a multiplicity of probes 502 of the plug 500 shown in FIG. 5. The other probes are identical to the probe illustrated in FIG. 5. The tapered base 516 of the probe shell 514 enhances the mechanical reliability of the probe 502 by increasing its strength. Further mechanical enhancement is provided by an enlargement 518 of the conductive shaft 517. As shown in FIG. 5, the plug body 508 is provided with grip rings 520 for better bonding to cable termination material.

As illustrated in FIG. 6, the plug body 508 has a mating keyway 538 with a flared entrance that engages the mating key 278 on the receptacle sleeve 260. The mating keyway is illustrated in the Inventor's U.S. Pat. No. 5,203,805, which is incorporated herein by reference.

The base 510 is provided with two annular grooves 540, in which are seated O-ring seals 542. The O-rings 542 prevent the passage of water or other material from the outside environment into the interior of the plug 500, where the material could contact the probes 502 and thereby contaminate the connection. A snap-ring 544 and a shoulder 546 on the boot seal 510 holds the boot seal 510 within the plug body 508. O-rings 548 are seated in annular grooves 550 formed in the dielectric portion 514 of the probe 502, which O-rings 548 also seal the interior of the plug 500 against the penetration of water or other material from the outside environment.

When the plug body 508 is brought together with the receptacle 200 of FIG. 2, the plug body 508 is turned until the alignment key 278 is engaged by the flared opening of the flared mating keyway 538. The plug body 508 and receptacle shell 260 are pushed together axially, while being slightly rotated on axis to enable the alignment key 278 to traverse into the narrow portion of the keyway 538. The alignment of the receptacle 200 and the plug body 508 by way of the key 278 and keyway 538 aligns the probes 502 in the plug assembly with the ports in the receptacle assembly 200, so that each probe 502 in the plug assembly 500 is mated with a respective socket 100 in the receptacle assembly. Further, the alignment provided by the key and keyway orients the probes in the plug assembly with the end cap holes 224 so that each probe is initially aligned with a contact hole for being received into a respective end seal port.

The plug body 508 is assembled to a plug-body locking sleeve 522 by means of a snap ring 524 that holds the rear lip 526 of the sleeve 522 between itself and a shoulder 528 in the plug body 508. The snap ring 524 is retained in an annular groove 530 formed on the rear portion of the plug body 508. Mating threads 532 are provided on the front inner-surface of the locking sleeve 522, while the difference in diameters between the bore of the locking sleeve 522 and the forward extension of the plug body 508 provide for a small space 534 between the sleeve 522 and the body 508. The locking sleeve 522 has grip ribs 536 aligned axially along the locking sleeve 522, as shown in FIG. 6. FIG. 6 also illustrates the keyway 538 formed in the plug body 508.

Figure 7:
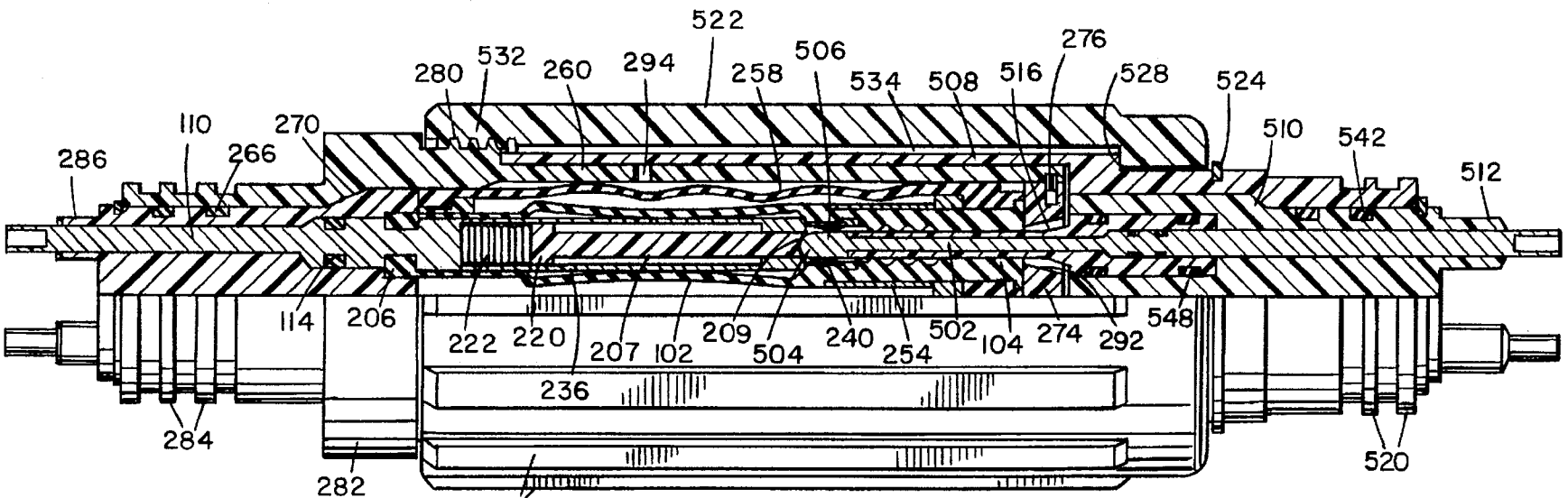
FIG. 7 is a side elevation view, in partial section, of the receptacle and plug units when fully mated.
Figure 8:
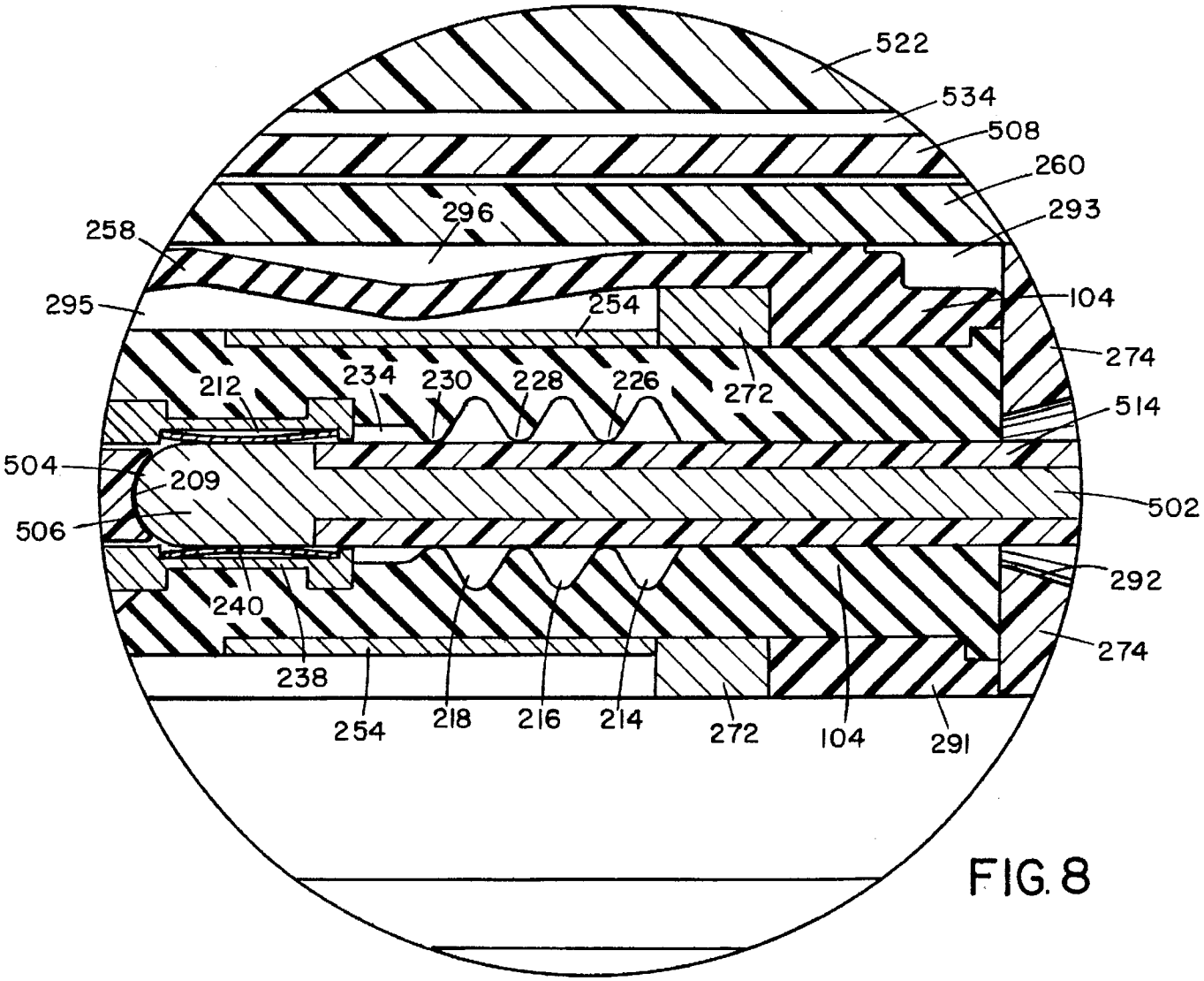
FIG. 8 is an enlarged view of the fully mated electrical socket/probe assemblies shown in the partial section of FIG. 7 in accordance with the present invention.

The connection between the receptacle 200 and the plug 500 is illustrated in FIGS. 7 and 8. As described above, the alignment key 278 is engaged by the keyway 538 to provide an initial alignment between the probes 502 and the plug 500 and the ports 224 in the receptacle 200. The plug 500 and receptacle 200 are pushed together, with the threads 532 of the plug engaging the threads 280 of the receptacle to retain the two connector halves in a mated operative engagement. As the two halves are brought together, each of the probes 502 and the plug assembly is aligned with and mated to a respective one of the multiplicity of electrical socket assemblies 100 in the receptacle.

Because the manner of engagement between the probe 502 and socket assembly 100 is the same for each of the probe/socket pairs, one description is given for the engagement of the probe tip 506 with the annular circuit contact ring 240 in the socket assembly 100. As the connector halves are brought together, the convex probe face 504 contacts the tapered surface 292 and is guided by it into contact with the concave recessed face 209 of the elongated shaft 208 of the stopper 207. The probe tip 506 pushes through the entry seal formed by the end seal 104 of the socket module assembly 100. Eventually, when the two connector halves are fully mated, the probe tip 506 has travelled into engagement with the annular circuit contact ring 240, pushing the stopper 207 into its retracted position inside the electrical socket assembly 100. Electrical conductivity is thereby established from the probe 502 through its tip 506, through the ring 240, through the forward piece 238, through the spring guide tube 236, and to the end piece 110. The spring 222 is fully compressed. When the two connector halves are demated, the probe tip 506 is withdrawn from the interior of the socket assembly 100 out through port 222, while the stopper 207 is urged by spring 222 back out into the hole in the end seal 104.

While the mating and demating sequences are occurring, various events occur in the fluid baths 210, 212, 214, 216, 218 within the socket assembly 100. As noted above, in the unmated condition, the stopper 207 is all the way out into the end seal 104, and the end seal constrictively squeezes around the elongated shaft 208 of stopper 207, sealing to it. There is fluid communication from the inner chambers 210, 212 to the outside annuli 214, 216, 218, which are defined by the corrugation nibs 226, 228, 230. At this point, then, only one oil chamber exists within the socket assembly 100, although its shape is complicated. As the probe 502 enters the port 224 and engages the concave end 209 of the stopper 207, the probe 502 displaces the stopper 207 inward. The probe 502 is wiped when passing through the interior of the end seal 104. As the probe proceeds inward, it forces the stopper 207 and some of the dielectric fluid held in the various annuli ahead of the probe and thence into the inner chamber of the module.

The stopper 207 is thus moving backward within the inside module chamber 210, meaning that the stopper 207 is displacing more and more volume within the inside module chamber 210 as it backs into the chamber. Accordingly, dielectric fluid within the spring-guide tube 236 redistributes within the inner module chamber, flowing through vent holes 248 into the space 250 around the outside of the spring-guide tube but still within the inner chamber formed by flexible bladder 102. The module flexible bladder wall 102 thus expands outward as the stopper 207 is pushed backward by the probe 502 into the chamber 210. As a consequence, the common oil chamber 295 defined by the common flexible bladder 258 has pressure applied to it, and the common bladder wall 258 thus expands outward to compensate for the increased pressure. As the common flexible bladder 258 expands outward, the water contained in chamber 296 defined by the exterior shell 260 is forced out of port 294 formed in the shell 260. Thus, pressure and volume changes within the interior of the socket assembly 100 are compensated via the flexible walls and fluid ports.

As the probe 502, which is slightly larger in diameter than the stopper 207, enters the first outside oil-filled annulus 214, some of the dielectric fluid contained in that sub-chamber is forced past the first corrugation nib 226 into the second annular space 216. As those skilled in the art will understand, this process continues, passing excess dielectric fluid from one annular space to the next. The probe 502, having a larger diameter than the stopper 207, lightly engages the first corrugation nib 226 as it passes by, and the corrugation nib 226 thus wipes the probe 502. The probe, engaging the corrugation nibs 226, 228, 230, seals off, lightly, to each of the nibs. As it seals to each nib, the probe 502 closes-off a small annular volume of dielectric fluid. The whole corrugated end seal structure, including the outside sub-chambers and corrugation nibs, which structure contains both dielectric fluid and elastomer material, is now in the final mated condition. The probe 502, when fully inserted, engages the annular circuit contact ring 240, establishing the electrical connection between the plug and the receptacle.

At this point, as illustrated in FIGS. 7 and 8, the receptacle 200 and probe 500 are in the fully mated condition. The probe 502 is in electrical contact via the tip 504 with the circuit contact element 240. The corrugation nibs 226, 228, 230 are lightly touching the nonconductive portion 514 of the probe. The outside oil-filled annuli 214, 216, 218 are thus lightly sealed off from one another via the corrugation nibs, as well as from the inside chambers 234, 212, 210.

In the fully mated condition, the probe 502 is lightly sealed to the corrugation nibs 226, 228, 230. These light-engagement seals offer two advantages over more constrictive seals. First, these light-engagement seals of the nibs to the probe prevent free-flow between the fluid-filled annuli, but do not form pressure-tight seals. Accordingly, in the event of any dynamic pressure or temperature gradients not otherwise accounted for, dielectric fluid can seep by the corrugation nibs and move between the various annuli 226, 228, 230 and between those annuli and the inside chambers 234, 210, 212. Thus, even when in the fully mated condition, minute amounts of dielectric fluid can pass between the inside chambers 234, 210, 212 and the fluid-filled annuli 214, 216, 218 in response to any pressure gradients which may occur between them. Secondly, light engagement seals offer much less friction against the sliding passage of the stopper and plug probe, thereby reducing the required spring force to reliably return the stopper to its fully outward position, and hence reducing the force necessary to engage the plug and receptacle.

When in the fully mated position, the probe 502 forms the inner wall of the annular fluid-filled spaces 214, 216, 218. Accordingly, those chambers have no need to adjust their volume in response to the insertion of solid material. The only volume changes that may take place in the chambers would be those due to compressibility and thermal expansion of the materials involved. It must be recognized, however, that this second category of adjustment represents volume changes that are small compared to the moving about of material that results when the connector is mated.

It is desirable to transmit the exterior pressure in the undersea environment to the interior of the connector and to allow the interior of the connector to adjust for differences in material compressibility and thermal expansion. The probe 502 may be taken to have a constant size independent of both temperature and pressure. The outside annuli, however, are formed by constrained elastomeric rubber walls and are filled with a dielectric fluid. Elastomers and dielectric fluids, unlike the probe 502, may undergo volume change due to temperature and/or pressure changes.

It is well known that, in response to changing pressures, a rubber elastomer behaves as a fluid. There is a difference, however, in that the elastomer retains small restoring forces internally that tend to return it to its original shape. Those forces are negligibly small compared to the forces due to changing pressure in the sea. Thus, for the range of pressures one encounters in the sea, for the purposes of volumetric considerations, at least, the rubber elastomer in the bulk sense may be viewed as a liquid.

Therefore, if the compressibility and thermal expansion of the elastomers and the dielectric fluids used in fluid-filled annuli 214, 216 and 218 of the electrical socket assembly 100 are identical, or at least substantially the same, the fluid and elastomer will change in complete harmony in response to these variables, requiring no net influx or outflow of fluid from the various annuli in the socket-module assembly 100. In the present invention, the compressibility of the rubber elastomer used for the socket-module assembly 100 is approximately $3.0\times10^{-6}$/PSI and the compressibility of the silicon dielectric fluid used within the socket module is identically $3.0\times10^{-6}$/PSI. Therefore, the dielectric fluid and elastomer in the connector, if so selected, will act in harmony, and there will be no requirement for dielectric fluid to influx or outflow from the outside annular fluid-filled spaces 214, 216, 218 due to pressure and/or temperature changes.

Nevertheless, in the present invention, even if the physical properties of the dielectric fluid and the elastomer are not perfectly matched, causing pressure gradients within the structure, such effects only cause radial forces on the probe 502 and therefore have little or no implication toward hydraulically locking the connector. Moreover, when fully mated, the seals formed between the corrugation nibs 226, 228, 230 and probe 502 are very light seals compared to the seal between the end seal 104 and probe 502. Therefore, any variation in volume within the outside fluid-filled annuli 214, 216, 218 can be compensated, even when fully mated, by the fact that fluid seepage between annuli can occur in response to pressure gradients between them. For example, if for whatever reason there should occur a slight volumetric increase of the oil in annular chamber 214 relative to the volume of the annulus itself, dielectric fluid could leak past corrugation nib 226, the fluid passing into the next innermost annulus 216. The addition of dielectric fluid into annulus 216 would force dielectric fluid past corrugation nib 228 and into the next inward annulus 218. The addition of dielectric fluid in the annulus 218 forces dielectric fluid past the final corrugation nib 230 and into the inside sub-chambers 234, 210, 212. It will be appreciated that such seepage from one annular chamber to another would be minute, but would be necessitated because the relatively thick elastomeric walls of the corrugations 214, 216, 218 are essentially rigid and do not flex to permit volume compensation in the traditional way of letting the chamber size increase. In other words, instead of the usual method of allowing the size of a chamber to increase/decrease in order to compensate for increased/decreased volume of material within the chamber, the annular chambers of the present invention simply allow some of the material to escape from them while keeping themselves the same size. Accordingly, changes in volume within annuli formed by the corrugations cannot be compensated by flexing the chamber walls, but can be compensated by transferring material from one space to another.

The entire end-seal complex, including the fluid-filled annuli 214, 216, 218 and except for the end seal 104, is encased within a rigid tubular sleeve 254 and an axially aligned bore within rigid spacer 272. This rigid containment acts as a squirm-guide for the corrugations, guaranteeing both that their axes will remain linear and that the cross-sectional area of the nibs and annuli will remain circular, and that the nibs will have a rigid backing against which to react.

In accordance with the present invention, two distinct types of volume variability are considered: (1) the movement of fluid displaced by insertion or withdrawal of the probe 502, and (2) the movement of material, both fluid and elastomeric, in response to changing pressures and temperatures. Although thermal and pressure changes of the materials involved in the present invention are small, they are still considered and accounted for in the present invention. They are accounted for by selecting the proper materials, i.e., those having the same compressibility and coefficient of thermal expansion, and by providing light, "leaky" seals between the corrugation nibs 226, 228, 230 and the probe 502.

It will be apparent to those skilled in the art that various modifications and variations can be made in the apparatus and method of the present invention without departing from the spirit or scope of the invention. Thus, it is intended that the present invention cover the modifications and variations of this invention, provided they come within the scope of the appended claims and their equivalents.

What is claimed is:

1. A submersible connector suitable for use in an outside environment, comprising:

a receptacle, including:

a receptacle shell;

a module chamber containing dielectric fluid and disposed in said receptacle shell, said module chamber having a wall comprising a compliant member, said compliant member flexing to compensate for pressure and volumetric variations within said module chamber;

a circuit contact located within said module chamber;

a sealable opening from said module chamber to said outside environment, said sealable opening including a sealing member incorporating a plurality of annular seals, said plurality of annular seals forming a plurality of spaces therebetween, said plurality of annular seals being in series, said plurality of spaces retaining dielectric fluid, an innermost space of said plurality of spaces being disposed adjacent said module chamber;

a resiliently biased stopper movably disposed within said module chamber, said stopper including an elongate shaft having a tip, said stopper being movable between a first position in which said shaft protrudes through said sealable opening, sealably engaging at least one of said plurality of annular seals, and a second position in which said shaft is retracted from said sealable opening into said module chamber, said elongate shaft in collaboration with said sealing member forming a fluid-tight seal between said module chamber and said outside environment when said stopper is in said first position; and a plug, including:

a plug shell; and a conductive plug probe having a tip, said plug probe being adapted for insertion into said module chamber through said sealable opening, said plug probe engaging said circuit contact when said stopper is in said second position, said plug probe forming a fluid-tight seal between said module chamber and said outside environment when said plug probe is disposed within said sealing member;

wherein, as said plug probe is inserted into the sealing member of said sealable opening, the tip of said plug probe engages the tip of said stopper, urging said stopper from said first position toward said second position, any excess of dielectric fluid between said plurality of annular seals being urged along with said stopper by said plug probe through said sealing member and into said module chamber; and wherein said plug probe forms light seals between said plurality of spaces formed by the plurality of annular seals, said light seals comprising means for restricting flow between said spaces and between said innermost space and the module chamber to seepage in response to any pressure gradients across said light seals.

2. The submersible connector recited in claim 1 wherein the compliant member of the module chamber flexes to enlarge the chamber volume as dielectric fluid, the stopper, and the plug probe move through the sealing member into the module chamber and flexes to diminish the volume of the module chamber as dielectric fluid, the stopper, and the plug probe move from the module chamber, thereby compensating for pressure and volume changes in the module chamber.

3. The submersible connector recited in claim 2 wherein the inside surface of the receptacle shell and the outside surface of the module chamber define a void, said void being filled with a material, and wherein the receptacle shell includes a port for communicating between the outside environment and said void, whereby some of the material that fills said void exits through said port as the compliant member of the module chamber flexes in such a way as to enlarge the module chamber and some of the material of the outside environment enters said void through said port as the compliant member of the module chamber flexes so as to diminish the volume of the module chamber.

4. The submersible connector recited in claim 3 wherein the receptacle further includes a common chamber, said common chamber having a compliant member, said common chamber housing within it the module chamber, the interior surface of said common chamber defining a common bath of dielectric fluid, and the outer surface of said common chamber, in cooperation with the interior surface of the receptacle shell, forming the void.

5. The submersible connector recited in claim 1 wherein a compliant material forms the annular seals within the sealing member, and wherein the compliant material forming the annular seals and the dielectric fluid within the module chamber have substantially the same compressibility.

6. The submersible connector recited in claim 5 wherein the compliant material forming the annular seals within the sealing means and the dielectric fluid within the module chamber have substantially the same coefficient of thermal expansion.

7. The submersible connector recited in claim 1 wherein the annular seals comprise a plurality of corrugation nibs, and wherein any excess of dielectric fluid in the sealing member is forced past the plurality of corrugation nibs and into the module chamber as the plug probe is inserted into the sealing member.

8. The submersible connector recited in claim 7 wherein the plug probe lightly contacts the corrugation nibs when the plug probe is disposed within the sealing member, whereby the plug probe contact with the nibs forms a light seal between the one or more annuli formed by the end seal and the corrugation nibs, said light seal permitting seepage between these annuli and the module chamber in response to any pressure gradients developing therebetween.

9. The submersible connector recited in claim 8 wherein the sealing member is substantially encased by a rigid wall, said rigid wall retaining the plurality of corrugation nibs from radially expanding, and retaining them in axial alignment.

10. The submersible connector recited in claim 1 wherein the stopper is resiliently biased by a spring located within a spring guide assembly, said spring guide assembly being located within the module assembly.

11. The submersible connector recited in claim 10 wherein the spring guide assembly contains dielectric fluid and includes a hole for passing dielectric fluid into and out of the spring guide assembly.

12. A submersible connector adapted for use in an outside environment, comprising:

a receptacle, including:

a receptacle shell;

a plurality of module chambers, each containing dielectric fluid and disposed in said receptacle shell, each said module chamber having a wall comprising a compliant member, said compliant member flexing to compensate for pressure and volumetric variations within said module chamber;

a plurality of circuit contacts, each corresponding to and being located within one of said plurality of module chambers;

a plurality of sealable openings, each sealable opening connecting a respective one of said module chambers to said outside environment, each said sealable opening comprising a sealing member incorporating a plurality of annular nibs in series;

a plurality of resiliently biased stoppers, each corresponding to one of said plurality of module chambers, each said stopper being movably disposed within the respective module chamber, said stopper, in collaboration with said sealing member, forming a fluid-tight seal between said module chamber and said outside environment when said stopper is disposed within said sealable opening;

a common chamber for housing the compliant members of said plurality of module chambers, said common chamber having a compliant member on at least one of its surfaces, and said common chamber defining a common bath containing dielectric fluid; and a plug, including:

a plug shell; and a plurality of plug probes, each corresponding to one of said plurality of module chambers, each said plug probe being adapted for insertion into said module chamber through said sealable opening;

wherein, as each said plug probe is inserted into the sealable opening of the respective module chamber, any excess of dielectric fluid within the plurality of annular nibs is forced through said sealable opening into said module chamber, thereby obviating pressure and volume changes in said sealing member due to the insertion of said plug probe; and wherein each said plug probe forms a fluid-tight seal between the respective module chamber and said outside environment when said plug probe is disposed within said sealable opening.

13. The submersible connector recited in claim 12 wherein, for each of the plurality of plug probes, the plug probe lightly contacts the plurality of annular nibs when the plug probe is disposed within the module chamber, whereby the plug probe forms a non-fluid-tight seal between a plurality of inside sub-chambers formed by the contact of the plug probe with the end seal and the plurality of annular nibs, and between the inside sub-chambers of the module chamber.

14. A receptacle for a submersible connector adapted for use in an underwater environment, comprising:

a receptacle shell;

a module chamber containing dielectric fluid and disposed in said receptacle shell, said module chamber having a wall comprising a compliant member, said compliant member flexing to compensate for pressure and volumetric variations within said module chamber;

a circuit contact located within said module chamber;

a sealable opening from said module chamber to an underwater environment, said sealable opening comprising a sealing means incorporating a plurality of corrugation nibs in series defining a plurality of sub-chambers and an end seal;

a resiliently biased stopper movably disposed within said module chamber, said stopper including an elongate tip, said stopper being movable between a first position in which said tip protrudes through said plurality of corrugation nibs and into said end-seal, and a second position in which said tip is retracted from said end-seal and said plurality of corrugation nibs into said module chamber, said tip forming a fluid-tight seal between said module chamber and said underwater environment when said stopper is in said first position, said sub-chambers being open to said module chamber when said stopper is in said first position such that dielectric fluid can move between said sub-chambers and said module chamber.

15. The receptacle recited in claim 14 wherein as a plug probe is inserted into the receptacle, urging the stopper from the first position to the second position, dielectric fluid is displaced from the plurality of outside sub-chambers inward into the inside chamber, the dielectric fluid passing by the plurality of corrugation nibs.

16. The receptacle recited in claim 15 wherein the plug probe lightly seals to the plurality of corrugation nibs.

17. The receptacle recited in claim 14 wherein the flexible compliant member and dielectric fluid have substantially the same compressibility and coefficient of thermal expansion.

* * * * *